US012214409B2

(12) United States Patent
Henda et al.

(10) Patent No.: US 12,214,409 B2
(45) Date of Patent: Feb. 4, 2025

(54) SEAMING DEVICE

(71) Applicant: TOYO SEIKAN GROUP ENGINEERING CO., Ltd., Yokohama (JP)

(72) Inventors: Shinichiro Henda, Yokohama (JP); Kazuki Takahashi, Yokohama (JP); Kazumoto Obata, Yokohama (JP)

(73) Assignee: TOYO SEIKAN GROUP ENGINEERING CO., Ltd., Yokohama (JP)

( * ) Notice: Subject to any disclaimer, the term of this patent is extended or adjusted under 35 U.S.C. 154(b) by 184 days.

(21) Appl. No.: 17/942,621

(22) Filed: Sep. 12, 2022

(65) Prior Publication Data

US 2023/0001468 A1 Jan. 5, 2023

Related U.S. Application Data

(63) Continuation of application No. PCT/JP2020/044472, filed on Nov. 30, 2020.

(30) Foreign Application Priority Data

Mar. 13, 2020 (JP) ..... 2020-044198
Mar. 13, 2020 (JP) ..... 2020-044199
(Continued)

(51) Int. Cl.
*B21D 51/26* (2006.01)
*B21D 51/32* (2006.01)
*B65B 7/28* (2006.01)

(52) U.S. Cl.
CPC ..... *B21D 51/32* (2013.01); *B21D 51/2653* (2013.01); *B21D 51/2692* (2013.01); *B65B 7/2807* (2013.01)

(58) Field of Classification Search
CPC ..... B21D 43/00; B21D 43/06; B21D 43/16; B21D 51/2653; B21D 51/2692;
(Continued)

(56) References Cited

U.S. PATENT DOCUMENTS

2018/0078991 A1* 3/2018 Obata et al. ..... B21D 51/2684

FOREIGN PATENT DOCUMENTS

JP S5868517 A * 4/1983
JP S58068517 A 4/1983
(Continued)

OTHER PUBLICATIONS

International Search Report dated Feb. 16, 2021, issued in counterpart International Application No. PCT/JP2020/044472. (2 pages).

*Primary Examiner* — Jared O Brown
(74) *Attorney, Agent, or Firm* — WHDA, LLP

(57) ABSTRACT

A seaming device can prevent the leakage of a lubricating oil from the in-machine housing of a chuck unit into a seaming operation space, prevent the occurrence of a defective product contaminated by the lubricating oil, and eliminate heat elongation due to heat generation to accurately maintain a seaming dimension. A seaming device includes: a chuck unit that positions a lid mounted on a can; and a seaming unit that seams the lid to the can, wherein the chuck unit has a spindle having a chuck for positioning the lid attached at a lower end thereof, a bearing that rotatably supports the spindle, and a non-contact type oil seal mechanism for sealing between the spindle and the in-machine housing at a position below the bearing.

5 Claims, 4 Drawing Sheets

(30) Foreign Application Priority Data

Mar. 13, 2020 (JP) ..... 2020-044200
Mar. 13, 2020 (JP) ..... 2020-044201
Mar. 13, 2020 (JP) ..... 2020-044202

(58) Field of Classification Search
CPC .... B21D 51/32; B21D 51/446; B65B 7/2807; B65B 7/285; B65G 47/84; B65G 47/846; B65G 59/108
USPC ..... 413/3, 45, 47, 50, 52
See application file for complete search history.

(56) References Cited

FOREIGN PATENT DOCUMENTS

| | | | | |
|---|---|---|---|---|
| JP | 62-244537 | A | | 10/1987 |
| JP | 2003-39129 | A | | 2/2003 |
| JP | 2003-137392 | A | | 5/2003 |
| JP | 2003200910 | A | * | 7/2003 |
| JP | 2003205334 | A | * | 7/2003 |
| JP | 2005-21922 | A | | 1/2005 |
| JP | 2005021922 | A | * | 1/2005 |
| JP | 2017-013122 | A | | 1/2017 |
| TW | 201707812 | A | | 3/2017 |
| WO | 2013/145018 | A1 | | 10/2013 |

* cited by examiner 324
320
323
325
326
329
327
327H
315
318
317
317
311
313
312
331
316
330
321
V

SEAMING DEVICE

TECHNICAL FIELD

The present invention relates to a seaming device characterized in the structure of the spindle shaft of a chuck unit in the seaming device for canning a beverage or the like in an aluminum can, a steel can, or the like.

BACKGROUND ART

Conventionally, a seaming device is known, which includes a can mounting unit that mounts a can in which a beverage or the like is filled, a chuck unit that is provided facing the can mounting unit, and a seaming roll that seams a lid to a can.

As shown in, for example, Patent Literature 1, a known seaming device includes: a seaming turret (1) that performs a seaming process of seaming a can and a lid; a carrying-in conveyor (supply conveyor 7) that supplies, to the seaming turret, a can before seaming; a lid conveyance turret (supply turret 3) of a lid supply unit that supplies a lid; a discharge turret (discharge turret 5) that carries out, from the seaming turret, a can after seaming; and a carrying-out conveyor (discharge conveyor 8) that carries out from the discharge turret to outside, a can.

Each of the seaming turret, the discharge turret, and the lid conveyance turret has, on an outer peripheral part thereof, pockets (fitting concave parts 2, 4, and 6) that separately accommodate and convey a can and a lid.

The respective pockets of the seaming turret have a can mounting unit (lifter 17) that mounts a can, a chuck unit (seaming chuck device 10) that is provided facing the can mounting unit, and seaming rolls (18 and 19) that seam a lid to a can.

In the seaming device thus configured, the speeds and timings of the respective turrets and the respective conveyors are adjusted by gears or the like, and the operations of the can mounting units, the chuck units, and the seaming units arranged for the pecks respectively are linked to the rotation of the seaming turret by gears, a cam mechanism, or the like. Thus, a can and a lid conveyed at a high speed can be continuously seamed while being transferred.

In the chuck unit, a spindle having a chuck that positions a lid attached at a lower end thereof is rotatably provided via a bearing. Further, in recent years, along with the speeding-up of a seaming device, a chuck is rotated at a higher speed, and a rotation operating part such as a bearing for supporting a spindle is lubricated by a lubricating oil so as to be able to withstand the high-speed rotation.

Further, in a known seaming device, a can, a lid, or a content is contaminated when a lubricating oil supplied to a rotation operating part enters a seaming operation space where a container such as a can or a lid is handled as shown in Patent Literature 2 and 3. In order to prevent the lubricating oil from entering the seaming operation space, the rotation operating part is surrounded with an in-machine housing and the used lubricating oil is accumulated in the bottom part of the in-machine. A fitting gap inevitably exists between the in-machine housing and the rotation operating part so as to enable the rotation of the rotation operating part. Therefore, in order to prevent the lubricating oil from leaking from the fitting gap, a contact type oil seal made of V-shaped rubber or the like is provided between the in-machine housing and the rotation operating part.

However, due to the characteristics of the contact type oil seal that slidingly contacts a rotating shaft, it is extremely difficult to perform complete sealing between the rotation operating part and the in-machine housing. If operation continues for a long period of time, a problem arises in that the fitting gap turns into a flow path to cause the leakage of the lubricating oil due to aged degradation or the like. When the leakage of the lubricating oil into the seaming operation space occurs, the lubricating oil scattered by a centrifugal force resulting from the rotation of a spindle contaminates a can and causes a large amount of defective products. Therefore, the accumulation, collection, and discharge of the oozed and leaked lubricating oil have been proposed.

Further, heat elongation occurs in components constituting the chuck unit due to the heat generation of the oil seal that slidingly contacts the rotating shaft, which may cause an adverse effect that a seaming dimension changes.

CITATION LIST

Patent Literature

[Patent Literature 1] Japanese Patent Application Laid-open No. S62-244537

[Patent Literature 2] Japanese Patent Application Laid-open No. 2003-137392

[Patent Literature 3] Japanese Patent Application Laid-open No. 2003-200910

SUMMARY OF INVENTION

Technical Problem

The present invention has been made in order to solve the above problems and has an object of providing a seaming device that can prevent the leakage of a lubricating oil from the in-machine housing of a chuck unit into a seaming operation space, prevent the occurrence of a defective product contaminated by the lubricating oil, and eliminate heat elongation due to heat generation to accurately maintain a seaming dimension.

Solution to Problem

In order to solve the above problems, the present invention provides a seaming device including:

a chuck unit that positions a lid mounted on a can; and a seaming unit that seams the lid to the can, wherein the chuck unit has a spindle having a chuck for positioning the lid attached at a lower end thereof, a bearing that rotatably supports the spindle inside an in-machine housing and is lubricated by a lubricating oil, and a non-contact type oil seal mechanism for sealing between the spindle and the in-machine housing at a position below the bearing.

Advantageous Effects of Invention

The seaming device of the present invention has the non-contact type oil seal mechanism for sealing between the spindle and the in-machine housing at the position below the bearing. Thus, the seaming device does not have a seal member that slidingly contacts a rotating shaft. Therefore, the seaming device is free from the characteristics of a contact type oil seal and does not suffer from the influence of aged degradation even when performing seaming at a high speed. The seaming device can prevent the leakage of the lubricating oil from the in-machine housing of the chuck unit into a seaming operation space, prevent the occurrence of a defective product contaminated by the lubricating oil, and obtain high productivity. Further, the occurrence of heat elongation in components constituting the chuck unit is avoided. Therefore, the seaming device can accurately maintain a seaming dimension.

According to a configuration in which the oil seal mechanism of the present invention has an umbrella-like slinger, the seaming device can cause the lubricating oil that has lubricated the bearing and flowed down toward a lower part to easily flow to a return flow path that is in communication with the inside of the in-machine housing by a centrifugal force. Therefore, the seaming device can reliably prevent the leakage of the lubricating oil into the seaming operation space.

According to a configuration in which a groove extending in a linear radial shape or a curved radial shape is formed on the lower surface of the slinger of the present invention, the seaming device can easily guide the lubricating oil that has flowed to the lower surface side of the slinger to a distant outer side and suppress the leakage of the lubricating oil from a fitting groove. Therefore, the seaming device can reliably prevent the leakage of the lubricating oil into the seaming operation space.

According to a configuration in which a return flow path that causes the lubricating oil to circulate toward the in-machine housing from the upper surface of the slinger of the present invention by a centrifugal force is provided, the seaming device can easily return the lubricating oil to the inside of the in-machine housing by a centrifugal force. Therefore, the seaming device can reliably prevent the leakage of the lubricating oil into the seaming operation space.

According to a configuration in which a drain structure that causes the lubricating oil to flow toward a lower part inside the in-machine housing when the seaming device stops, the seaming device can cause the lubricating oil that remains on the bearing at the stop of the seaming device and flows down to easily return to the inside of the in-machine housing. Therefore, the seaming device can reliably prevent the leakage of the lubricating oil into the seaming operation space.

According to a configuration in which a liquid intrusion preventing member is provided below the slinger of the present invention, the seaming device can prevent the leakage of the lubricating oil that has lubricated the bearing and flowed downward into the seaming operating space, while preventing the intrusion of a washing liquid from the seaming operation space, the vapor or the like of a content filled in a can, or the like into the in-machine housing.

DESCRIPTION OF EMBODIMENTS

Hereinafter, the present invention will be described in detail.

Figure 1:
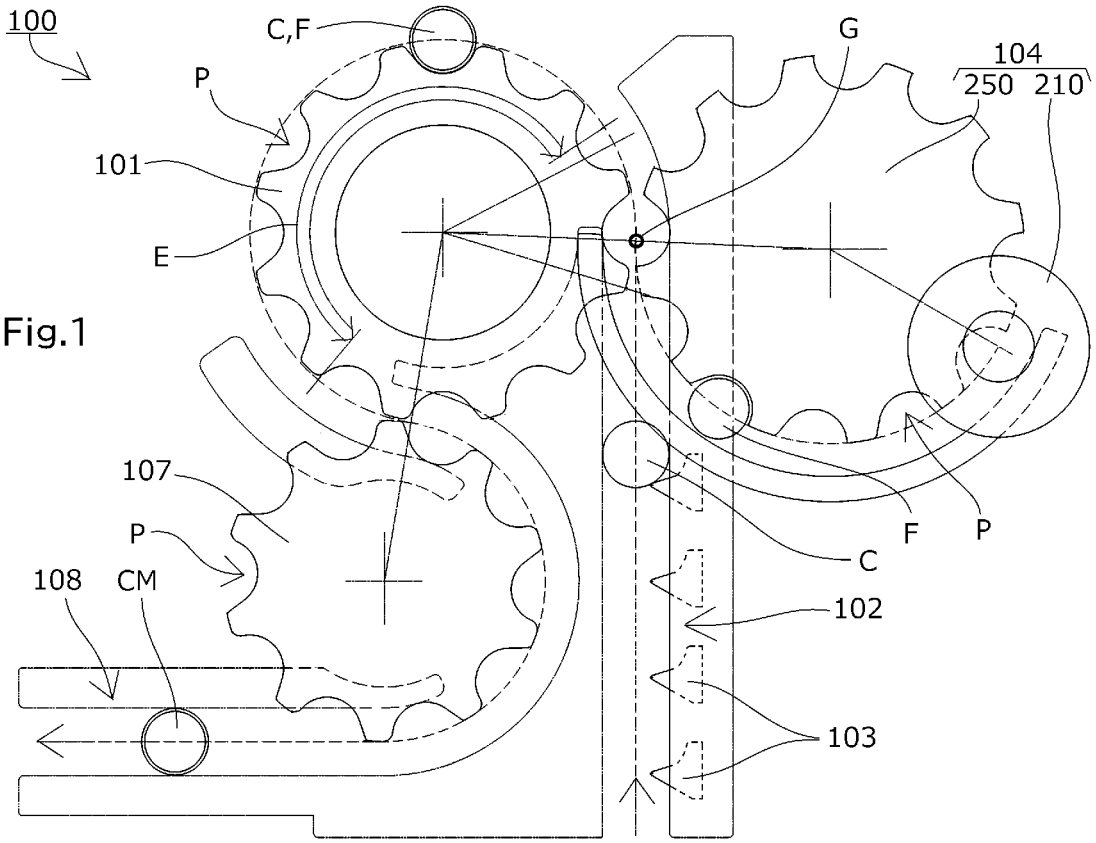
FIG. 1 is a schematic view showing an example of the configuration of a seaming device according to an embodiment of the present invention.

As shown in FIG. 1, a seaming device 100 according to an embodiment of the present invention includes: a seaming turret 101 that performs the seaming process of a can C and a lid F; a carrying-in conveyor 102 that supplies a can C before seaming to the seaming turret 101 in a non-rotated state; a lid supply device 104 that supplies a lid F and includes a lid separation unit 210 and a lid conveyance turret 250; a discharge turret 107 that carries out a can CM after seaming from the seaming turret 101; and a carrying-out conveyor 108 that carries out a can CM from the discharge turret 107 to an outside.

Each of the seaming turret 101, the discharge turret 107, and the lid conveyance turret 250 has pockets P that separately accommodate and convey cans C and CM and a lid F on their outer peripheral parts, and the carrying-in conveyor 102 has attachments 103 that separately engage and convey a can C.

The rotation speeds of the seaming turret 101, the discharge turret 107, and the lid conveyance turret 250, the movement speed of the attachments 103 of the carrying-in conveyor 102, and a timing at which the respective pockets P and the attachments 103 are linked to each other are adjustably designed so that cans C and CM and a lid F are smoothly transferred between the respective turrets and the conveyors.

Figure 2:
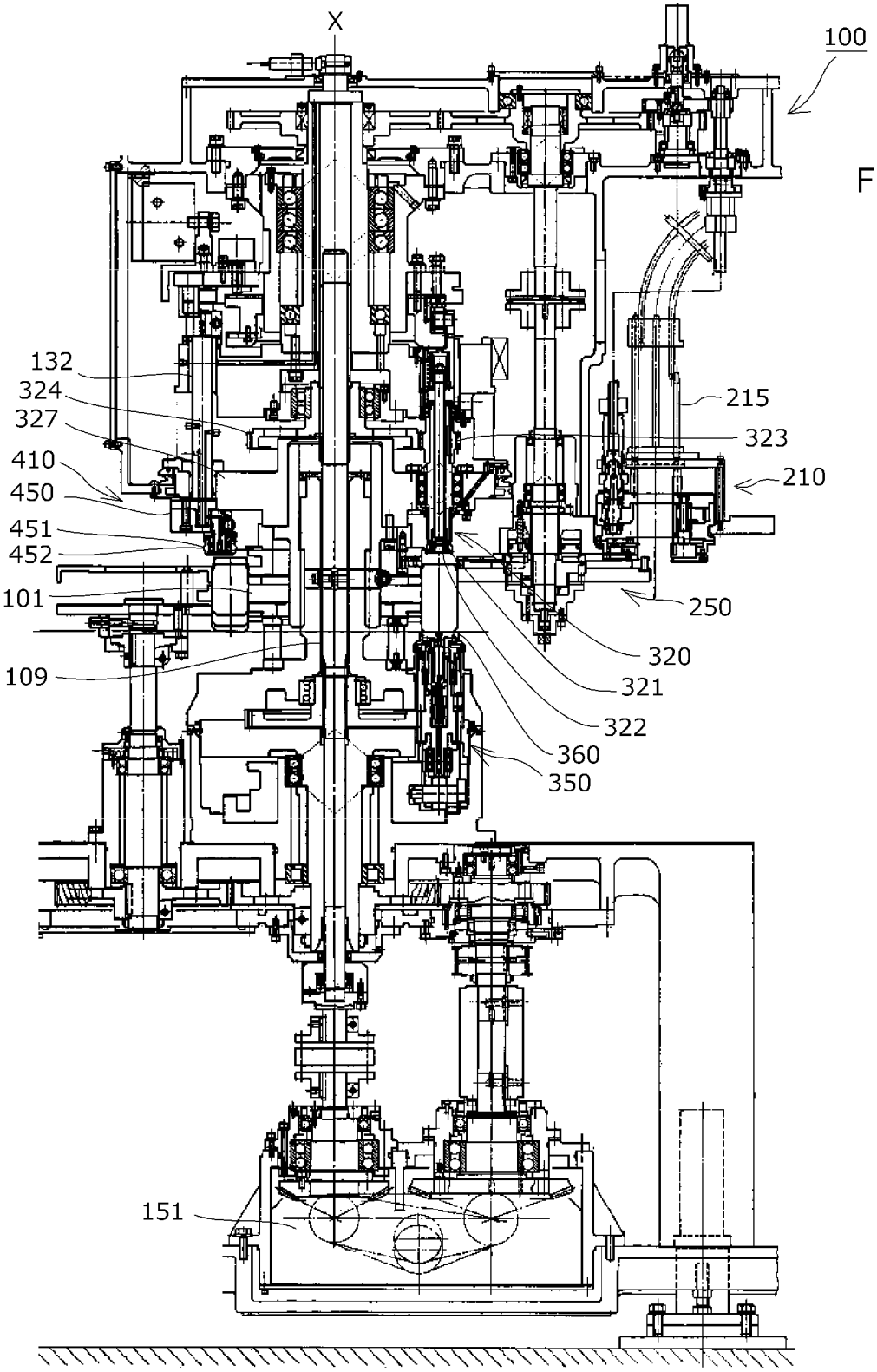
FIG. 2 is a cross-sectional view showing an example of the configuration of the seaming device according to the embodiment of the present invention.

As shown in FIG. 2, the seaming turret 101 that performs the seaming process of a can C and a lid F includes: a can mounting unit 350 that mounts a can C and rotates the same; a chuck unit 320 that is provided facing the can mounting unit 350 and has a chuck 321 that positions a lid F mounted on a can C and a knockout pad 322 that is fitted to be vertically movable inside the chuck 321 so as to press the lid F mounted on the can C; and a seaming unit 410 having seaming rolls 451 and 452 that seam a lid F to a can C in each of the pockets P.

The seaming turret 101 is arranged to be rotatable about the center shaft 109 with its central axis X extending in a vertical direction, and is rotationally driven by a driving mechanism 151 of the seaming turret 101.

The lid separation unit 210, the lid conveyance turret 250, and the carrying-in conveyor 102 are mechanically driven by the driving mechanism 151 of the seaming turret 101 via a transmission mechanism.

The chuck unit 320 is arranged to be rotatable about the center shaft 109 with its central axis X extending in a vertical direction and face the can mounting unit at an equal angular interval, and an outer surface gear 323 of a rotating shaft that supports the chuck 321 at its lower end engages a sun gear 324 supported by the center shaft 109. The chuck unit 320 revolves with the rotation of the center shaft 109 and a center column, and the chuck 321 rotates on its axis with the engagement between the sun gear 324 and the outer surface gear 323.

The chuck 321 is provided to be fixed and rotatable in a vertical direction. As shown on the right side of the central axis X in FIG. 2, the centering of a lid F is performed in such a manner that a can C on which the lid F has been mounted by lifting the can mounting unit 350 is fitted with the lower end outer peripheral surface of the chuck 321 while being sandwiched between the knockout pad 322 and the can mounting unit 350.

Figure 3:
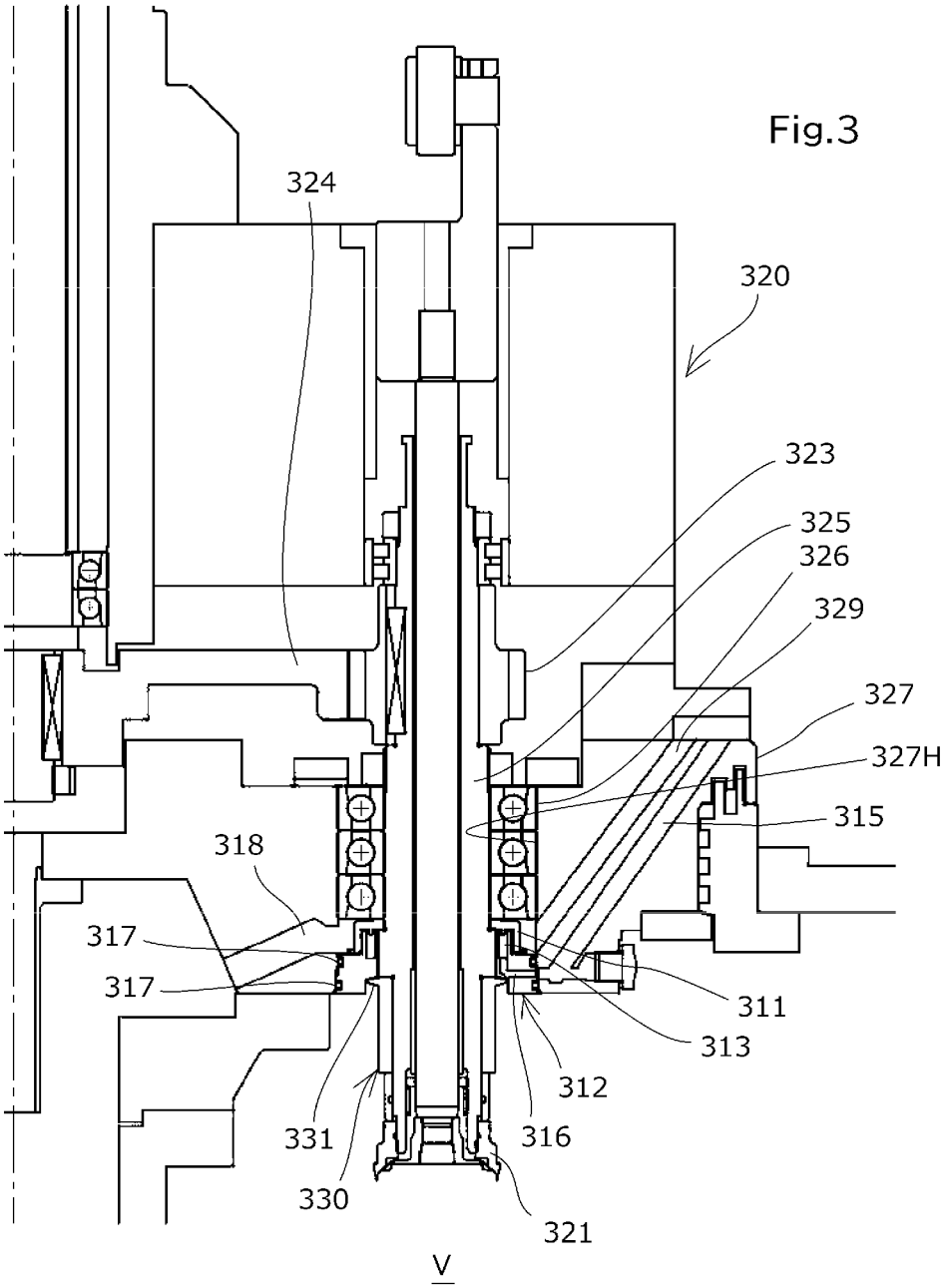
FIG. 3 is a cross-sectional view showing an example of the configuration of the chuck unit of the seaming device according to the embodiment of the present invention.

The chuck unit 320 has a chuck spindle 325 having the chuck 321 for positioning a lid F attached at its lower end. As shown in FIG. 3, the chuck spindle 325 is provided at an equal angular interval to penetrate the outer peripheral part of a table 327 that rotates about the central axis X of the seaming turret 101 so as be freely rotatable via a bearing 326 inside a penetration hole 327H. Each chuck spindle 325 rotates on its axis and is caused to revolve by the table 327.

The bearing 326 is lubricated by a lubricating oil. Further, the seaming device 100 of the embodiment has a non-contact type oil seal mechanism for sealing between the chuck spindle 325 and the table 327 at a position below the bearing 326. Thus, the seaming device 100 seals between the inside of an in-machine housing and a seaming operation space V for a can C.

In the oil seal mechanism, a metallic annular umbrella-like slinger 311 is provided below the bearing 326 on the periphery of the chuck spindle 325 to be fitted into the chuck spindle 325 so as to rotate with the chuck spindle 325. The umbrella-like slinger 311 is arranged with its upper end surface positioned at the lower part of the bearing 326 and its umbrella lower part expanding outward and downward in a radial direction from the shaft center of the chuck spindle 325.

At a position most separated from the central axis X of the seaming turret 101 in the penetration hole 327H of the table 327, one end (entrance) of a return flow path 329 penetrating the inside of the table 327 is opened. The other end (exit) of the return flow path 329 is in communication with the inside of the in-machine housing. The return flow path 329 causes the lubricating oil to circulate toward the in-machine housing from the upper surface of the umbrella-like slinger 311 by a centrifugal force and extends outward and upward in the radial direction of the central axis X of the seaming turret 101. When the chuck spindle 325 rotates on its axis, the lubricating oil having lubricated the bearing 326 flows downward and contacts the upper surface of the umbrella-like slinger 311. Then, the lubricating oil moves outward in the radial direction on the surface and is swept away (scattered) outward in the radial direction of the central axis X of the seaming turret 101 along the return flow path 329 by a centrifugal force resulting from the rotation of the table 327 (the revolution of the seaming turret 101).

Figure 4:
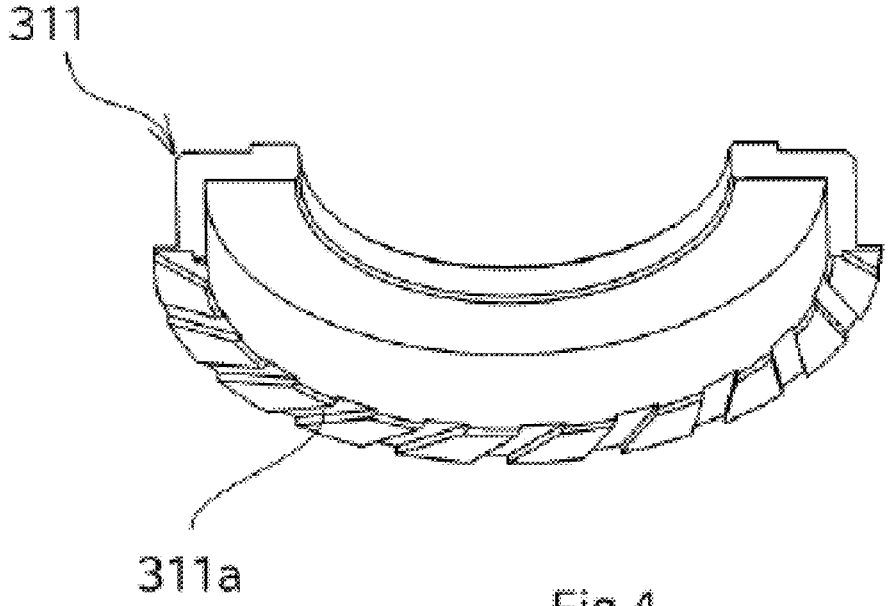
FIG. 4 is a cross-sectional view showing an example of the configuration of the chuck unit of the seaming device according to the embodiment of the umbrella-like slinger.

At a position closest to the central axis X of the seaming turret 101 in the penetration hole 327H of the table 327, a drain flow path (drain structure) 318 that extends downward in the direction of the center shaft 109 and is in communication with the in-machine housing is formed inside the table 327. When the seaming device 100 stops, the drain flow path 318 can cause the lubricating oil to flow down toward a lower part inside the in-machine housing along the upper surface of the umbrella-like slinger 311 due to its natural drop. Further, as shown by FIG. 4, the umbrella-like slinger 311 has, on its lower surface (rear surface), grooves 311*a* extending in a linear radial shape or a curved radial shape toward an outer peripheral edge from the shaft center side of the chuck spindle 325. A plurality of the grooves 311*a* are preferably formed to be evenly separated in a circumferential direction. The curved grooves include arc-shaped grooves or spiral-shaped (swirl-shaped) grooves.

Below the umbrella-like slinger 311, an annular member 312 is provided so as to be liquid-tightly inscribed in the lower part of the penetration hole 327H of the table 327 via two O-rings 317 and 317. The umbrella-like slinger 311 is labyrinthically fitted so as to cover the upper side and the lateral peripheral surface of an annular rail part 313 on which an annular groove that is formed inside in the circumferential direction of the annular member 312 and opened upward while protruding upward. By such a configuration, the lubricating oil that lubricates the bearing 326 and drops while being guided by the upper surface of the umbrella-like slinger 311 is intercepted by the annular rail part 313 and prevented from flowing into the gap between the annular member 312 and the chuck spindle 325.

Below the return flow path 329 inside the table 327, one end (entrance) of a fail-safe 315 penetrating the inside of the table 327 is opened at a position facing the exit of a return flow path 316 that bends and penetrates downward and in a lateral direction from the annular rail part 313. The other end (exit) of the fail-safe 315 is in communication with the inside of the in-machine housing. The fail-safe 315 extends upward in the radial direction of the central axis X of the seaming turret 101. In the fail-safe 315, the lubricating oil that has not flowed (scattered) into the return flow path 329 via the umbrella-like slinger 311 by a centrifugal force resulting from the rotation of the table 327 and remained inside the annular member 312 is returned to the inside of the in-machine housing by the centrifugal force.

The oil seal mechanism is constituted by the umbrella-like slinger 311, the annular member 312, and a cylindrical sleeve 330.

Below the annular member 312, a cylindrical sleeve 330 that has at its upper part a fringe 331 protruding outward in the radial direction from the shaft center of the chuck spindle 325 and tightly seals between the cylindrical sleeve 330 and the annular member 312, and that serves as an intrusion preventing member fitted into the chuck spindle 325 is provided to be fitted into the chuck spindle 325 so as to rotate with the chuck spindle 325.

The seaming unit 410 performs double seaming with seaming rolls 451 and 452 each pivotally fitted to both ends of a seaming lever 450 so as to rotate, the seaming lever 450 having its central part fixed to the lower end of a revolving roll swinging shaft 132.

In a double seaming process, a curled portion of a lid F is wrapped into a flange portion of a can C by the seaming roll 451 in primary seaming, and then crimping and bonding are performed by the fastening of seaming roll 452 to maintain sealing in secondary seaming.

The basic operation of the seaming device 100 thus configured will be described.

A can C to which a lid F has been seamed is conveyed while engaging each of the attachments 103 of the carrying-in conveyor 102 and directed to the seaming turret 101 rotated by the driving mechanism 151 of the seaming turret 101.

On the other hand, the lid F is cut out one by one from the lid separation unit 210, transferred to each of the pockets P of the lid conveyance turret 250, and directed to the seaming turret 101 by the rotation of the lid conveyance turret 250 (see FIG. 1).

The speeds and timings of the carrying-in conveyor 102 and the lid conveyance turret 250 are adjusted according to the speed and timing of the seaming turret 101 so that the centers of the can C and the lid F are aligned with each other at a merging point G. When the can mounting unit 350 of which the rotation is controlled via appropriate gears, a cam mechanism, or the like by the driving mechanism 151 to which power has been applied from a driving source not shown is lifted at the merging point G, the lid F is mounted on the can C mounted on the plate 360.

After that, the can mounting unit 350 is further lifted, the knockout pad 322 inside the chuck 321 presses the lid F, and the chuck 321 of which the rotation is controlled via appropriate gears, a cam mechanism, or the like by the driving mechanism 151 is fitted into the lid F to perform the centering of the lid F. The can C on which the lid F has been mounted is sandwiched between the plate 360, the chuck 321, and the knockout pad 322 at a constant axial load necessary for seaming.

Then, the seaming turret 101 further rotates, and the plate 360 and the chuck 321 accelerate up to their rotation numbers necessary for seaming before the sandwiched lid F and the can C reach a seaming interval E shown in FIG. 1.

While passing through the seaming interval E, the seaming lever 450 fixed to the lower end of the roll swinging shaft 132 of the seaming unit 410 is swung. Thus, two seaming rolls 451 and 452 for primary and secondary seaming each pivotally fitted to both ends so as to rotate are sequentially pressed against the can C and the flange of the lid F mounted on the can C from their lateral sides toward the chuck 321 to perform double seaming.

The can CM having completed the seaming is transferred from the seaming turret 101 to the discharge turret 107 and then transferred from the discharge turret 107 to the carrying-out conveyor 108 to be carried out to a next process such as inspection and packaging.

In the chuck unit 320 during the movement of the seaming device 100, the chuck spindle 325 rotates on its axis with the engagement between the sun gear 324 and the outer surface gear 323, while revolving with the rotation of the table 327 about the central axis X of the seaming turret 101, and on the basis of the revolution and the rotation, a seaming operation is performed to seam a lid F to a can C in cooperation with the chuck 321 and the seaming rolls 451 and 452. At this time, the lubricating oil flows down while lubricating the bearing 326, is guided from the upper surface to the lower end of the umbrella-like slinger 311, and is swept away outward in the radial direction of the central axis X of the seaming turret 101 along the return flow path 329 and returned to the inside of the in-machine housing by a centrifugal force resulting from the rotation of the chuck spindle 325 on its axis and the rotation of the table 327. Further, the lubricating oil that has slightly remained on the annular member 312 without flowing into the return flow path 329 is swept away outward and upward in the radial direction of the central axis X of the seaming turret 101 along the fail-safe 315 by the centrifugal force resulting from the rotation of the table 327 and returned to the in-machine housing. On the other hand, when the seaming device 100 stops, the lubricating oil having lubricated the bearing 326 drips downward and is guided from the upper surface to the lower end of the umbrella-like slinger 311 due to its natural drop, and then returned to the in-machine housing in the direction of the center shaft 109 by the drain flow path 318 due to its natural drop.

Further, the cylindrical sleeve 330 having the fringe 331 serving as the intrusion preventing member prevents a washing liquid, steam, or the like for washing and sterilizing the seaming operation space V from intruding into the penetration hole 327H or mixing in the lubricating oil from below the annular member 312.

REFERENCE SIGNS LIST

100 Seaming device
101 Seaming turret
102 Carrying-in conveyor
103 Attachment
104 Lid supply device
107 Discharge turret
108 Carrying-out conveyor
109 Center shaft
132 Roll swinging shaft
151 Driving mechanism
210 Lid separation unit
250 Lid conveyance turret
311 Umbrella-like slinger
312 Annular member
313 Annular rail part
317 O-ring
315 Fail-safe
318 Drain flow path
320 Chuck unit
321 Chuck
322 Knockout pad
323 Outer surface gear
324 Sun gear
325 Chuck spindle
326 Bearing
327 Table
327H Penetration hole
329 Return flow path
330 Cylindrical sleeve
331 Fringe
350 Can mounting unit
360 Plate
410 Seaming unit
450 Seaming lever
451 Seaming roll (primary seaming)
452 Seaming roll (secondary seaming)
C Can (before seaming lid)
F Lid
CM Can (after seaming lid)
P Pocket
E Seaming interval
V Seaming operation space
X Central axis

The invention claimed is:

1. A seaming device comprising:

a chuck unit that positions a lid mounted on a can; and a seaming unit that seams the lid to the can, wherein the chuck unit has a spindle having a chuck for positioning the lid attached at a lower end thereof, a bearing that rotatably supports the spindle inside an in-machine housing and is lubricated by a lubricating oil, and a non-contact oil seal mechanism for sealing between the spindle and the in-machine housing at a position below the bearing, the oil seal mechanism includes an umbrella-shaped slinger provided below the bearing, an annular member is provided below the slinger so as to labyrinthically fit the slinger, an intrusion preventing member including a cylindrical sleeve extending in a vertical direction is formed below the slinger around the spindle, the cylindrical sleeve includes a fringe fourth to last line protruding radially outward relative to a vertical centerline of the cylindrical sleeve and sealing between the cylindrical sleeve and the annular member, the oil seal mechanism is configured by the slinger, the annular member and the cylindrical sleeve.

2. The seaming device according to claim 1, wherein the slinger has, on a lower surface thereof, a groove having a linear radial shape or a curved radial shape and extending toward an outer peripheral edge from a shaft center side of the spindle.

3. The seaming device according to claim 2, wherein the oil seal mechanism has a return flow path that causes the lubricating oil to move toward the in-machine housing from an upper surface of the slinger by a centrifugal force when the seaming device operates.

4. The seaming device according to claim 1, wherein the oil seal mechanism has a drain structure that causes the lubricating oil to flow toward a lower part inside the in-machine housing when the seaming device stops.

5. The seaming device according to claim 1, wherein a fail-safe for causing the lubricating oil to flow toward an inside of the in-machine housing is formed below the slinger.

* * * * *